US007905271B2

(12) United States Patent
Schmitz et al.

(10) Patent No.: US 7,905,271 B2
(45) Date of Patent: Mar. 15, 2011

(54) APPARATUS FOR CARRYING COOLING WATER AWAY FROM THE NARROW SIDES OF A SLAB

(75) Inventors: Wolfgang Schmitz, Düsseldorf (DE); Axel Stavenow, Düsseldorf (DE)

(73) Assignee: SMS Siemag Aktiengesellschaft, Dusseldorf (DE)

( * ) Notice: Subject to any disclaimer, the term of this patent is extended or adjusted under 35 U.S.C. 154(b) by 438 days.

(21) Appl. No.: 12/084,739

(22) PCT Filed: Oct. 17, 2006

(86) PCT No.: PCT/EP2006/009979
§ 371 (c)(1),
(2), (4) Date: Jul. 18, 2008

(87) PCT Pub. No.: WO2007/054181
PCT Pub. Date: May 18, 2007

(65) Prior Publication Data

US 2008/0290224 A1 Nov. 27, 2008

(30) Foreign Application Priority Data

Nov. 12, 2005 (DE) ..... 10 2005 054 073

(51) Int. Cl.
*B22D 11/124* (2006.01)

(52) U.S. Cl. ..... 164/444; 164/486

(58) Field of Classification Search ..... 164/486–487, 164/444
See application file for complete search history.

(56) References Cited

U.S. PATENT DOCUMENTS 4,000,771 A * 1/1977 Williamson ..... 164/484

FOREIGN PATENT DOCUMENTS

DE 1 558 239 3/1970
DE 2 143 962 3/1972

* cited by examiner

*Primary Examiner* — Kuang Lin
(74) *Attorney, Agent, or Firm* — Lucas & Mercanti, LLP; Klaus P. Stoffel

(57) ABSTRACT

The invention relates to an apparatus (100) for carrying cooling water away from the narrow sides (210) of a slab (200) passed essentially vertically through a secondary cooling device after casting in a continuous casting installation. In order to prevent partial overcooling of the slab at its edges, the apparatus (100) according to the invention comprises a plurality of water drainage devices (110-*n*), which are arranged such that they are distributed in a vertical direction over the length of the narrow side of the slab. This plurality of water drainage devices (110-*n*) is carried by a vertically arranged collecting downpipe (120). The collecting downpipe additionally serves for collecting the cooling water that is drained by the plurality of water drainage devices (110-*n*) and carrying it away in a decentralized manner.

9 Claims, 1 Drawing Sheet

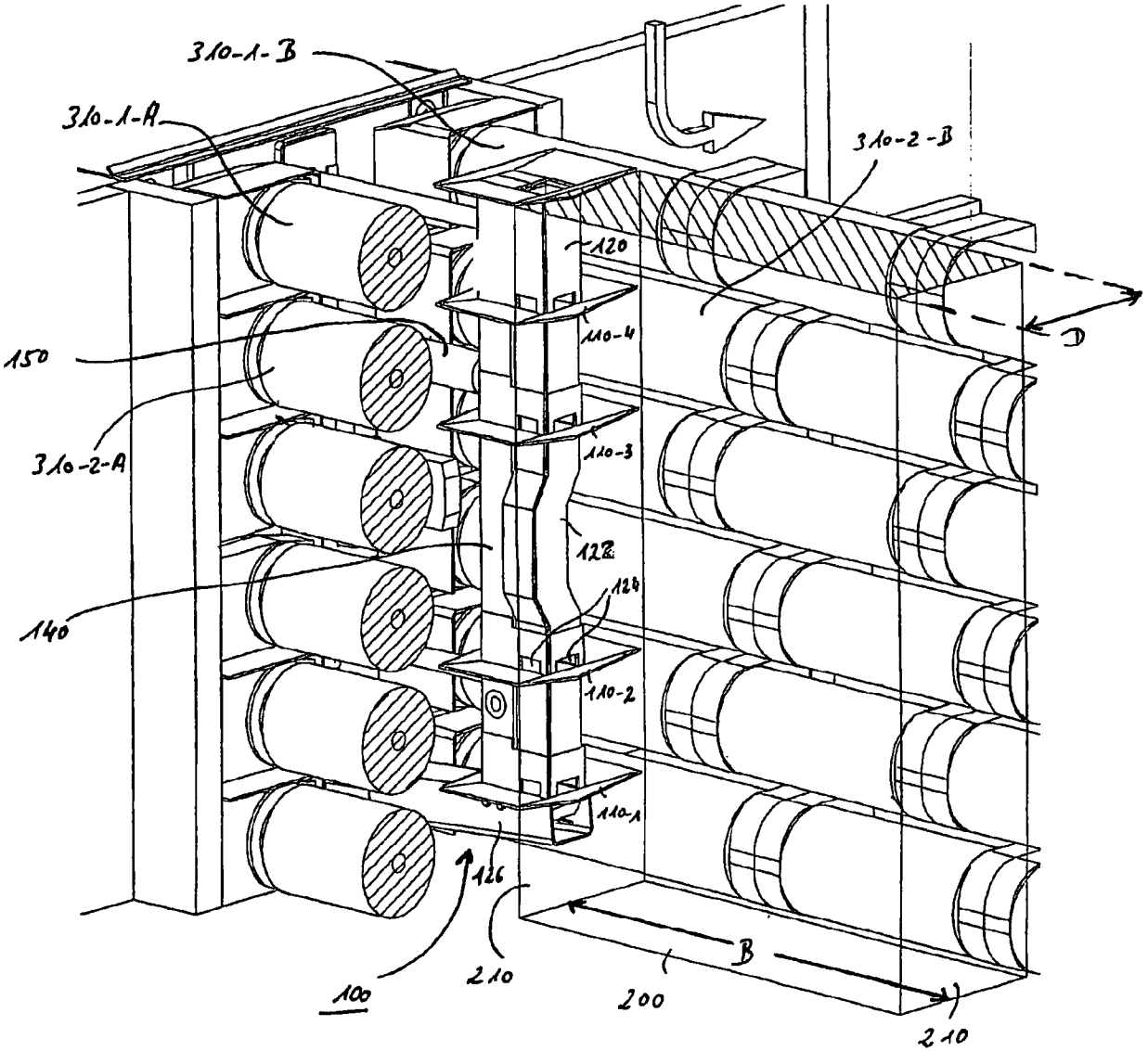
C
3,10-2-B
3,10-1-B
3,10-1-A
3,10-2-A
150
140
120
3,10-4
3,10-3
122
124
3,10-2
3,10-1
126
210
B
200
210
100

APPARATUS FOR CARRYING COOLING WATER AWAY FROM THE NARROW SIDES OF A SLAB

BACKGROUND OF THE INVENTION

The invention concerns a device for carrying cooling water away from the narrow sides of a slab, especially in the secondary cooling system of a continuous casting installation.

When a cast strand or a slab passes vertically through a secondary cooling system, cooling water accumulates in a wedge-shaped region between the guide rollers of the secondary cooling system and the surface of the strand. The cooling water that temporarily accumulates in the wedge-shaped region then typically flows off downward over the narrow sides of the slabs.

A device for collecting and removing cooling water of this type is described, for example, in German Offenlegungsschrift DE 1 558 239. The device disclosed there provides for only a single water drainage device on each narrow side of the slab, and each of these drainage devices is arranged below or at the foot of the secondary cooling system and its guide rollers. A water pipe is arranged downstream of each of the water drainage devices for removing the cooling water picked up by each of the water drainage devices. Since only one water drainage device and water pipe are provided on each narrow side, they each collect the entire amount of cooling water that flows off from the wedge-shaped regions of all guide rollers located at a higher level over the respective narrow sides of the slab. Each of the water drainage devices can be moved towards or away from the associated narrow side of the slab by means of an adjusting device.

However, because it is located only at the foot of or below the secondary cooling system, this previously known device for removing cooling water from the narrow sides of a slab has the disadvantage that the entire amount of cooling water emerging from all of the wedge-shaped regions located at all of the higher levels flows past each unit of area of the given narrow side. Therefore, this results in a nonuniform distribution of the cooling water and of the resulting cooling effect over the length of the narrow side, because more cooling water from more wedge-shaped regions flows past the lower regions of the narrow side than past the higher regions of the narrow side. Precisely in these lower regions of the narrow sides, i.e., at the end of the secondary cooling system, there then exists the danger of undesired overcooling of these regions of the narrow side due to an excessive amount of water per unit area flowing past these regions.

Therefore, proceeding from this prior art, the objective of the invention is to refine a previously known device for carrying cooling water away from the narrow sides of a slab in such a way that overcooling of the edges or lateral surfaces of the slab is prevented.

SUMMARY OF THE INVENTION

This objective is achieved by the object of Claim 1. In accordance with this solution to the problem, in a device in accordance with the invention a plurality of water drainage devices is vertically distributed over the length of the narrow side, and the water pipe is designed as a collecting downpipe, which supports the plurality of water drainage devices and connects them with one another for the collection and central removal of the cooling water drained by the plurality of water drainage devices.

In the specification which follows, we shall speak only of a slab as the object to be cooled, However, the present invention is by no means limited exclusively to slabs, but rather the term slab is used to represent other possible objects to be cooled in a secondary cooling system, for example, steel bars, billets, or various forms of slabs, such as ingot slabs or thin slabs.

The claimed device makes it possible for cooling water to be locally carried away at several different places along the narrow sides of a slab by means of the water drainage devices. This has the advantage that partial accumulation of an undesirably large amount of cooling water does not occur on the narrow sides of the slab, and undesired partial overcooling of the edge regions of the slab is thus avoided.

In accordance with a first advantageous embodiment, this is achieved by assigning each narrow side of the slab and preferably each pair of guide rollers of the secondary cooling system with its own water drainage device. In the context of the present specification, a pair of guide rollers comprises a first guide roller on a fixed side and a second guide roller, which is arranged opposite the first guide roller, on the loose side of the secondary cooling system.

It is advantageous if the width of the water drainage devices corresponds to the greatest possible thickness of the slabs to be processed. This configuration of the width of the water drainage devices offers the advantage that even in the case of the thickest slabs, removal of the cooling water is guaranteed over the entire thickness of the slab, i.e., over the entire width of its narrow side. However, this does not prevent the cooling water from also being effectively locally removed by means of the water drainage devices in the case of slabs of lesser thickness; this is especially the case if the water drainage devices, together with the collecting downpipe, are each arranged symmetrically to the middle of the narrow side of a slab to be cooled.

If slabs are being cooled whose thickness is less than the maximum possible thickness, then the water drainage device preferably projects symmetrically on the right and the left beyond the given narrow side. However, this projection of the water drainage devices is possible only if the water drainage devices can get out of the way to the right and left beyond the slab thickness. In order to guarantee this, the water drainage devices are preferably each arranged at half the height between two pairs of guide rollers of the secondary cooling system that are arranged vertically one above the other. The water drainage devices can then get out of the way by entering the gaps between two guide rollers arranged one above the other, especially during an adjustment of the device to a thinner slab format.

In the event that slabs with different thicknesses and widths are to be cooled, it is necessary to move the device of the invention appropriately in each case. To this end, the device of the invention has an adjustment mechanism that preferably allows two-dimensional movement of the collecting pipe with the water drainage devices. Movement of the device in the width direction of the slab is advantageous for guaranteeing suitable adjustment of the water drainage devices when there is a change in the width of the slabs to be cooled. Similarly, movement of the device in the thickness direction of the slab is advantageous for guaranteeing symmetrical orientation of the water drainage devices when there is a change in the thickness of the slabs to be cooled.

The collecting downpipe with the water drainage devices is preferably connected with the adjustment mechanism by means of an interposed mounting device. This has the advantage that—as seen from the narrow side of the slab—the adjustment mechanism is located behind the collecting pipe and the mounting device, so that the collecting pipe and the mounting device protect it from the cooling water flowing off on the narrow side.

It is also advantageous if the collecting pipe has braking elements, for example, in the form of a curved guide in certain sections, for slowing the falling speed of the cooling water in the collecting downpipe. Damage of the collecting downpipe due to excessive falling speed of the cooling water can be prevented by the braking elements.

Finally, it is advantageous to construct the water drainage devices as water chutes made of sheet metal, because this is especially inexpensive.

The invention is described in detail below on the basis of specific embodiments and with reference to the sole drawing that accompanies the specification.

DETAILED DESCRIPTION OF THE PREFERRED EMBODIMENT

The drawing shows the device 100 of the invention for carrying cooling water away from the narrow sides 210 of a slab 200, which is guided essentially vertically through a secondary cooling system after it has been cast in a continuous casting installation. The drawing shows only the guide rollers 310 of the secondary cooling system but not the spray nozzles for applying the cooling water especially to the broad sides of the slab 200. The drawing also shows that the device of the invention has a plurality of water drainage devices 110-*n*, where n=1 . . . N. The water drainage devices 110-*n* are arranged vertically over the length of the narrow side 210 of the slab 200 and are supported by a collecting pipe 120. The water drainage devices 110 are preferably constructed as water chutes. The cooling water drained off from all of these chutes at different locations on the narrow side of the slab passes through holes 124 to the inside of the collecting downpipe, in which it falls vertically downward until it enters a transverse channel 126, which carries it away from the slab.

The device 100 of the invention with the collecting downpipe 120 and the water drainage devices mounted on the downpipe can be moved by means of an adjustment mechanism 150, preferably two-dimensionally, i.e., in the direction of the thickness D of the slab and/or in the direction of the width B of the slab. This ability of the device to be moved allows individual adjustment of the device to altered width and thickness formats of the slabs passing through the secondary cooling system. An adjustment to altered slab widths is made by moving the device in direction B of the slab width in such a way that, even with the changed slab width, the water drainage devices 110 are located, if at all possible, in the immediate vicinity of the new position of the narrow sides of the slabs to allow optimal drainage of the cooling water there. In accordance with the invention, an adjustment to altered slab thicknesses is made by moving the device in the direction of the thickness D of the slab in such a way that the permanently preset width of the water drainage devices is symmetrically oriented to the narrow side of the slab.

In accordance with the invention, the width of the water drainage device is dimensioned in such a way that it corresponds to the maximum possible width of a slab. In this way, it would be ensured, above all, that even in the case of the thickest slabs, the water drainage devices would cover the entire width of the narrow sides of the slabs, i.e., it would be ensured that even in the case of the thickest slabs, equal portions of the cooling water from the wedge-shaped region between the associated rollers and the slabs would be carried away on the fixed side and the loose side.

In order not to have to exchange the water drainage devices 110 with their width adjusted to the thickest slabs 200 during the cooling of thinner slabs and at the same time in order to prevent these water drainage devices from being crushed by the guide rollers 310 moved in the direction of the thickness D for the purpose of adjusting to thinner slabs, the invention provides that the chutes, which are typically constructed in the form of metal sheets, are mounted on the collecting downpipe 120 in such a way that they can collect the cooling water at half the height between two guide rollers 310-1-*a*, 110-2-*a* of the secondary cooling system that are arranged vertically one above the other. When the guide rollers 310 are moved in direction D for the purpose of adjustment to smaller slab thicknesses, the essentially horizontally extending water drainage devices 110-*n* can then get out of the way by entering the gaps between two guide rollers 110-1-*a*, 110-2-*a* and thus avoid being crushed.

It is advantageous for the collecting downpipe 120 to have a braking element 122 in the form of a bend or a diverting device, as shown in the drawing, in order to produce a local reduction of the falling speed of the cooling water.

The invention claimed is:

1. A device (100) for carrying cooling water away from the narrow sides (210) of a slab (200), which is guided essentially vertically through a secondary cooling system after it has been cast in a continuous casting installation, where the device comprises on at least one of the narrow sides (210): at least one water drainage device (110-*n*) adjusted to the narrow side for draining the cooling water that is flowing off on the narrow side (210) and a water pipe downstream of the water drainage device for carrying away the cooling water received by the water drainage device, wherein a plurality of water drainage devices (110-*n*) is vertically distributed over the length of the narrow side (210), and the water pipe is designed as a collecting downpipe (120), which supports the plurality of water drainage devices (100-*n*) and connects them with one another for the collection and central removal of the cooling water drained by the plurality of water drainage devices (110-*n*).

2. A device (100) in accordance with claim 1, wherein on at least one narrow side, one of the water drainage devices (110-*n*) is assigned to each pair of guide rollers (310-*x*-A, 310-*x*-B) of the secondary cooling system.

3. A device (100) in accordance with claim 1, wherein the width of the water drainage devices (100-*n*) corresponds to the greatest possible thickness (D) of the slab (200).

4. A device (100) in accordance with claim 3, wherein the width of the water drainage devices (110-*n*) is symmetrically oriented with respect to the middle of the narrow side (210).

5. A device (100) in accordance with claim 2, wherein the water drainage devices (110-*n*) are arranged at half the height between two guide rollers (310-1, 310-2) of the secondary cooling system that are arranged vertically one above the other.

6. A device (100) in accordance with claim 1, wherein the collecting downpipe (120) with the water drainage devices (110-*n*) is connected by means of a mounting device (140) with an adjustment mechanism (150), which allows one-dimensional or two-dimensional movement of the device (100) in the width direction (B) and/or thickness direction (D) of the slab (200).

7. A device (100) in accordance with claim 6, wherein the mounting device (140) is located between the collecting downpipe (120) and the adjustment mechanism (150).

8. A device (100) in accordance with claim 1, wherein the collecting downpipe (120) has braking elements (122) for slowing the falling speed of the cooling water.

9. A device (100) in accordance with claim 1, wherein the water drainage devices are constructed in the form of sheet-metal water chutes.

* * * * *